US011713768B1

(12) United States Patent
Shane et al.

(10) Patent No.: US 11,713,768 B1
(45) Date of Patent: Aug. 1, 2023

(54) IMPELLER FOR A CENTRIFUGAL PUMP

(71) Applicant: Robert Bosch GmbH, Stuttgart (DE)

(72) Inventors: Trevor Shane, New Upper Falls, MA (US); Peter Pulai, South Deerfield, MA (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/846,468

(22) Filed: Jun. 22, 2022

(51) Int. Cl.
*F04D 29/22* (2006.01)
*F04D 1/00* (2006.01)
*F04D 13/06* (2006.01)

(52) U.S. Cl.
CPC ..... *F04D 29/22* (2013.01); *F04D 1/00* (2013.01); *F04D 13/06* (2013.01)

(58) Field of Classification Search
CPC ..... F04D 29/22
See application file for complete search history.

(56) References Cited

U.S. PATENT DOCUMENTS

| | | | | |
|---|---|---|---|---|
| 3,139,831 | A | 7/1964 | Pollack | |
| 3,535,051 | A * | 10/1970 | Turner | F04D 29/2266 415/196 |
| 4,854,820 | A | 8/1989 | Zolotar | |
| 5,209,635 | A | 5/1993 | Stewart et al. | |
| 5,605,434 | A | 2/1997 | Haag et al. | |
| 7,429,160 | B2 | 9/2008 | Roudnev et al. | |
| 7,465,153 | B2 | 12/2008 | Addie et al. | |
| 8,210,816 | B2 | 7/2012 | Geldenhuys | |
| 2014/0105747 | A1* | 4/2014 | Burgess | F04D 7/04 416/189 |
| 2015/0308446 | A1* | 10/2015 | Koivikko | F04D 29/2216 415/208.3 |

* cited by examiner

*Primary Examiner* — Sabbir Hasan
(74) *Attorney, Agent, or Firm* — Kelly McGlashen

(57) ABSTRACT

A centrifugal pump includes an impeller that is rotatable about a rotational axis. The impeller includes impeller vanes disposed between a base plate and a shroud. The shroud outer surface includes recessed pump out vanes. For each pump out vane, the ratio R1 of the vane outer diameter to the shroud outer diameter is in a range of 0.8 to 0.98, the number of vanes N is in a range of 5 to 9, the ratio R2 of the width of the pump out vane to the shroud outer diameter is in a range of 0.02 to 0.04 and the pump out vane has a square leading edge profile with a square or chamfered trailing edge profile.

13 Claims, 9 Drawing Sheets

Orthogonal Array for Pump Out Vane Study

| TEST | VANE WIDTH | VANE DIAMETER | NUMBER OF VANES | VANE EDGE PROFILE |
|---|---|---|---|---|
| 1 | R2(1) | R1(1) | N1 | CLE-STE |
| 2 | R2(1) | R1(2) | N2 | SLE-STE |
| 3 | R2(1) | R1(3) | N3 | SLE-CTE |
| 4 | R2(2) | R1(1) | N2 | SLE-CTE |
| 5 | R2(2) | R1(2) | N3 | CLE-STE |
| 6 | R2(2) | R1(3) | N1 | SLE-STE |
| 7 | R2(3) | R1(1) | N3 | SLE-STE |
| 8 | R2(3) | R1(2) | N1 | SLE-CTE |
| 9 | R2(3) | R1(3) | N2 | CLE-STE |

FIG. 12

IMPELLER FOR A CENTRIFUGAL PUMP

BACKGROUND

Electric vehicle cooling systems may be complex and may be used to regulate the temperature of several components within the vehicle, including the vehicle battery pack, control electronics, the electric drive motor(s) and the vehicle cabin. One or more centrifugal fluid pumps may be used as cooling circuit pumps in the cooling system of a motor vehicle. Fluid pump performance is key to successful and reliable cooling of the electric vehicle. Pump performance may be measured, for example, in terms of pump pressure or hydraulic efficiency, where the term "hydraulic efficiency" refers to the ratio of hydraulic power produced by the pump to the electrical power consumed by the pump.

In some centrifugal fluid pumps, internal leakage and recirculation have a strong negative effect on pump performance. Leakage may occur, for example, between a shroud of the pump impeller and the pump casing in such a way that fluid exiting the impeller recirculates to the impeller inlet. Therefore, it would be advantageous to reduce internal leakage at this location in order to improve pump performance.

SUMMARY

A centrifugal fluid pump is disclosed that employs features that reduce internal leakage and recirculation between the pump shroud and the pump casing. The features include back-skewed pump out vanes. As used herein, the term "back-skewed" refers to vanes having a concave edge that faces opposite the direction of rotation of the impeller. The pump out vanes are recessed into the surface of the shroud in order to maintain the axial and radial clearances between the impeller shroud and the pump casing. The pump out vanes act to pump fluid radially out of the leakage path between the pump shroud and the pump casing, reducing volumetric losses due to internal leakage and recirculation, and thus improving pump performance and efficiency.

In order to minimize fluid leakage and recirculation between the shroud outer surface and the pump housing, the configuration of the pump out vanes was optimized with respect to one or more of the features of the pump out vanes that affect fluid pumping efficiency of the pump out vanes, taking into account interaction between the features. The optimized features included the number of pump out vanes employed, the width of the pump out vanes, the diameter of the pump out vanes and the edge profile of the pump out vanes.

In some aspects, an impeller for a centrifugal pump is rotatable about a rotational axis. The impeller includes a shroud having a shroud outer surface, a shroud inner surface and a shroud outer diameter. The impeller includes a base plate including a base plate inner surface. In addition, the impeller includes impeller blades that are disposed between the shroud inner surface and the base plate inner surface. The shroud outer surface includes pump out vanes. Each pump out vane has a leading edge, a trailing edge and a vane floor that extends between the leading edge and the trailing edge. In addition, each pump out vane has a tip corresponding to a radially outer most edge of the vane, a vane width corresponding to a distance between the leading edge and the trailing edge and a vane outer diameter corresponding to a distance between the rotational axis and the tip. The vane floor of each pump out vane is recessed relative to the shroud outer surface, and for each pump out vane, the ratio of the vane outer diameter to the shroud outer diameter is in a range of 0.8 to 0.98.

In some embodiments, for each pump out vane, the ratio of the vane outer diameter to the shroud outer diameter is in a range of 0.9 to 0.96. In other embodiments, for each pump out vane, the ratio of the vane outer diameter to the shroud outer diameter is in a range of 0.93 to 0.95. In still other embodiments, for each pump out vane, the ratio of the vane outer diameter to the shroud outer diameter is 0.94.

In some embodiments, the shroud outer surface is free of pump out vanes having a ratio of the vane outer diameter to the shroud outer diameter of 1.0.

In some embodiments, for each pump out vane, the ratio of the vane width to the shroud outer diameter the vane width is in a range of 0.02 to 0.04. In other embodiments, for each pump out vane, the ratio of the vane width to the shroud outer diameter the vane width is 0.03.

In some embodiments, for each pump out vane, the leading edge is square and the trailing edge is chamfered. In other embodiments, for each pump out vane, the leading edge is square and the trailing edge is square.

In some embodiments, the number of vanes is seven.

In some embodiments, each pump out vane has a back skewed spiral shape when the shroud is viewed in a direction parallel to the rotational axis.

In some embodiments, each pump out vane extends linearly along a radius of the shroud.

In some embodiments, each pump out vane has a constant width between a root of the vane and the tip of the vane, where the root corresponds to a radially innermost edge of the vane.

In some aspects, an impeller for a centrifugal pump is rotatable about a rotational axis. The impeller includes a shroud, a base plate including a base plate inner surface and impeller blades that are disposed between the shroud inner surface and the base plate inner surface. An outer surface of the shroud includes pump out vanes. Each pump out vane has a leading edge, a trailing edge and a vane floor that extends between the leading edge and the trailing edge. In addition, each pump out vane has a tip corresponding to a radially outer most edge of the vane, a vane width corresponding to a distance between the leading edge and the trailing edge and a vane outer diameter corresponding to a distance between the rotational axis and the tip. The number of pump out vanes is seven. In addition, for each pump out vane, the leading edge has a square edge profile, the trailing edge has a chamfered edge profile, the ratio of the vane outer diameter to the shroud outer diameter is 0.85, and the ratio of the vane width to the shroud outer diameter the vane width is 0.02.

In some aspects, an impeller for a centrifugal pump is rotatable about a rotational axis. The impeller includes a shroud, a base plate including a base plate inner surface and impeller blades that are disposed between the shroud inner surface and the base plate inner surface. An outer surface of the shroud includes pump out vanes. Each pump out vane includes a leading edge, a trailing edge and a vane floor that extends between the leading edge and the trailing edge. In addition, each pump out vane includes a tip corresponding to a radially outer most edge of the vane, a vane width corresponding to a distance between the leading edge and the trailing edge and a vane outer diameter corresponding to a distance between the rotational axis and the tip. The number of pump out vanes is seven. In addition, for each pump out vane, the leading edge has a square edge profile, the trailing edge has a square edge profile, the ratio of the vane outer diameter to the shroud outer diameter is 0.9, and the ratio of the vane width to the shroud outer diameter the vane width is 0.03.

BRIEF DESCRIPTION OF THE DRAWINGS

FIG. 12 is a table representing the orthogonal array of four variables used to determine the best combination of design parameters for the shroud pump out vanes.

DETAILED DESCRIPTION

Figure 1:
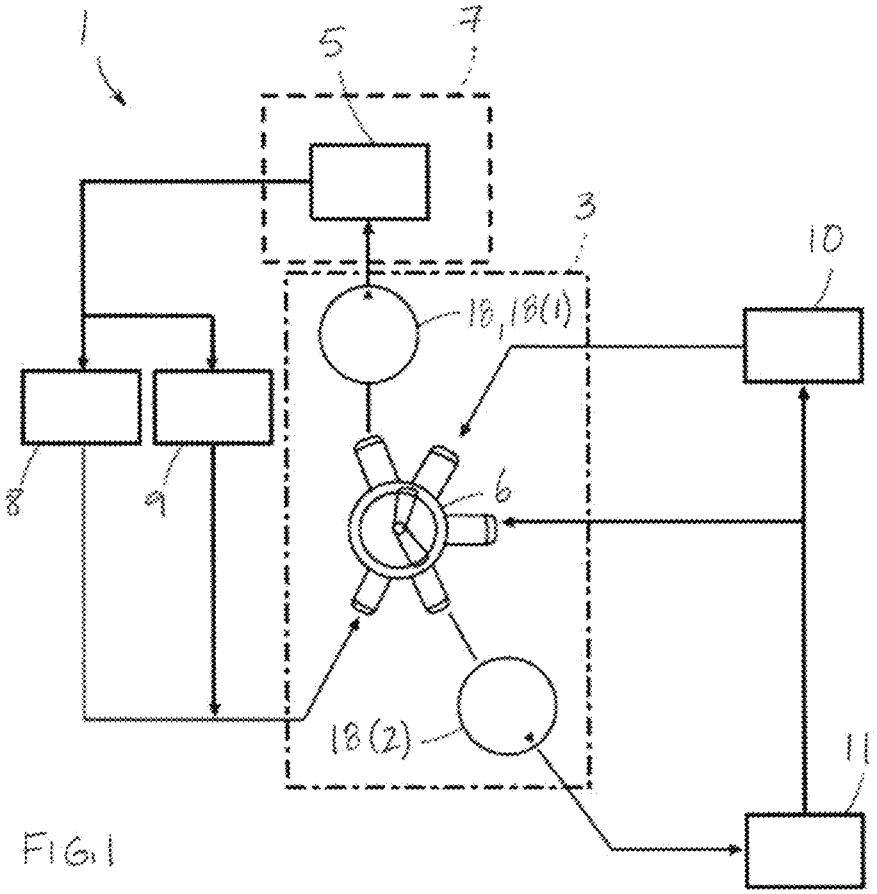
FIG. 1 is a schematic diagram illustrating a fluid delivery system that includes volute-type centrifugal fluid pumps configured to drive fluid therein.

Referring to FIG. 1, a fluid delivery system 1 includes a multi-port rotary valve 6 that is capable of controlling fluid flow driven by one or more volute-type centrifugal fluid pumps 18 between three, four, five or more individual fluid lines within the system 1. The rotary valve 6 may be used, for example, to control the distribution and flow of coolant among branches of a vehicle cooling system 1 of an electric vehicle. In this example, a first pump 18(1) may drive coolant fluid between the rotary valve 6 and a radiator 5 that is part of a vehicle passenger cabin heating and cooling system 7, where coolant from the radiator 5 may also cool a battery 8 and battery management system 9. In addition, a second pump 18(2) may drive coolant fluid to heat exchangers 10, 11 that support temperature control of other vehicle devices and systems, such as an electric drive motor, vehicle electronics and/or electronic control units and/or the oil supply.

Figure 2:
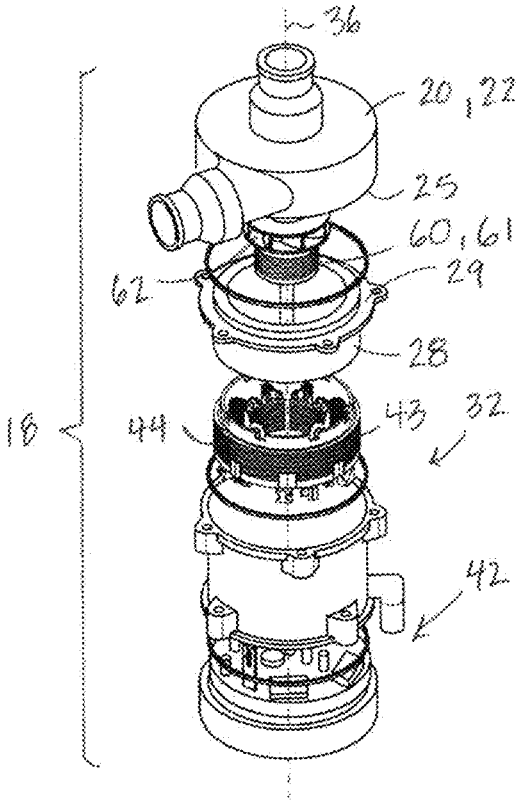
FIG. 2 is an exploded view of a volute-type centrifugal fluid pump.
Figure 3:
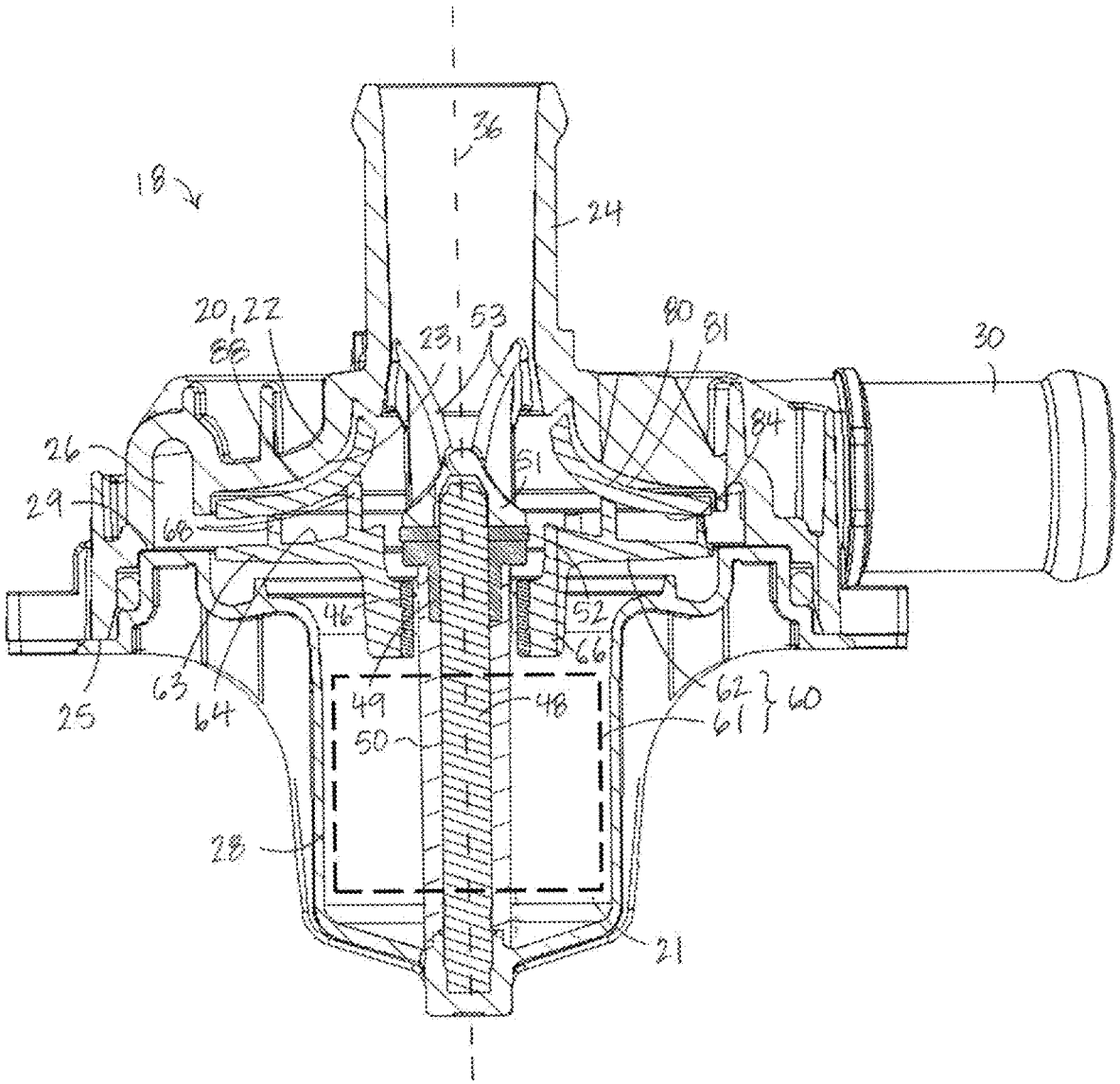
FIG. 3 is a cross-sectional view of the wet portion of the fluid pump.
Figure 4:
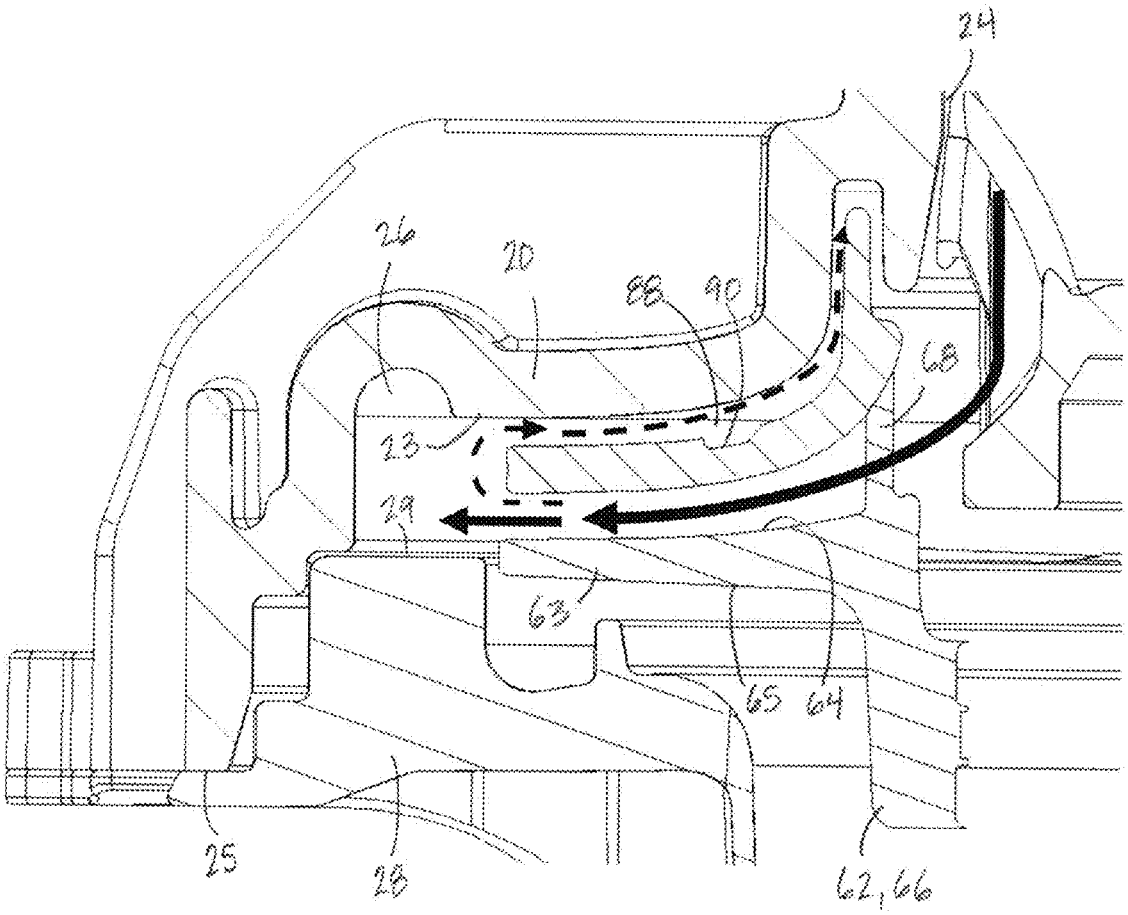
FIG. 4 is an enlarged portion of the fluid pump of FIG. 3 illustrating fluid flow in the vicinity of the impeller, where solid arrows represent the main fluid path between the impeller inlet and a volute of the pump housing, and broken arrows represent a recirculation and/or leakage fluid path.

Referring to FIGS. 2-3, the volute-type centrifugal fluid pump 18 includes a pump casing 20 that defines a "wet area" through which fluid is pumped, and an electric drive 32 that drives the pump 18. The pump casing 20 is formed by a first casing part referred to as the pump housing 22 and a second casing part referred to as the motor pot 28. The motor pot 28 is a cup shaped structure including an open end 29 that faces the pump housing 22. The pump housing 22 is also generally cup shaped and has an open end 25 that faces the motor pot 28. The pump housing 22 and motor pot 28 are assembled together with the respective open ends 25, 29 adjoining to form an enclosed fluid chamber 21. The fluid chamber 21 forms the wet area of the pump 18.

The motor pot 28 separates the wet area from the dry area, which includes most components of the electric drive 32. The electric drive 32 has a rotor unit 60, a stator 43 and includes control electronics which are referred to generally by reference number 42. In FIG. 2, the electric drive 32 is shown schematically. Since the structure and functionality of a suitable electric motor are sufficiently known from the prior art, a detailed description of the electric drive 32 is omitted for the sake of brevity and simplicity of the description.

The rotor unit 60 is disposed in the fluid chamber 21 and includes a rotor 61 (the rotor 61 is shown schematically in FIG. 2 using broken lines) and an impeller 62, which are connected to one another in a rotationally fixed manner whereby movement of the rotor 61 is transmitted to the impeller 62. When the pump 18 is in operation, the rotor unit 60 conveys fluid through the wet area by means of the impeller 62.

The stator 43 is disposed outside the motor pot 28 (e.g., the stator 43 is disposed in the dry area) and is controlled by the control electronics 42. The stator 43 includes a plurality of coils 44 that surround the motor pot 28 in the vicinity of the rotor 61 along the circumference of the rotor 61. When the electric drive 32 is in operation, the stator coils 44 generate a rotating magnetic field, by means of which the rotor unit 60 is driven to rotate about a rotational axis 36.

The rotor unit 60 is rotatably mounted on a pump shaft 48 via bearings 49, 50. The pump shaft 48 is fixed relative to the pump casing 20. In some embodiments, the bearing 50 is designed as a sleeve bearing. The rotational axis 36 runs through the center of the pump shaft 48 in the axial direction and thus corresponds to the center axis of the pump shaft 48.

A first end of the pump shaft 48 faces the pump housing primary inlet 24 and is connected in a rotationally fixed manner to a stop element 51 that protrudes from an inner surface of the pump housing 22 so as to be centered on the rotational axis 36 in the vicinity of the primary inlet 24. In particular, the bearing 49 is provided on the shaft first end, and the sleeve bearing 50 surrounds the pump shaft 48 and extends between the motor pot 28 and the bearing 49. The stop element 51 is part of a bearing point for the rotor unit 60 and prevents the pump shaft 48 from moving in the radial and axial directions. The stop element 51 has a circular profile and is connected to the pump casing 20 via holding webs 53. The holding webs 53 are arranged on the circumference of the stop element 51 and are connected to the inner surface of the pump housing primary inlet 24. At its second end, the pump shaft 48 is fixed relative to an inner surface of the motor pot 28, for example by insert molding. The stop element 51 minimizes or restricts a deflection of the bearing 49 or the sleeve bearing 50 in the axial direction and, as a result, an axial deflection of the impeller 62. During operation, such an axial deflection of the impeller 62 may be generated, for example, by the axial thrust of the rotor 61.

The sleeve bearing 50 is designed as part of the rotor 61 and thus moves (e.g., rotates) relative to the stop element 51 during operation. In order to minimize the high frictional forces between the sleeve bearing 50 and the stop element 51 as well as the associated sluggishness of the rotor 61 and the resulting wear of the stop element 51, a thrust washer 52 is provided between the stop element 51 and the bearing 49. The thrust washer 52 is preferably designed in such a way that there is a friction-optimized material pairing between the thrust washer 52 and the bearing 49.

Referring also to FIGS. 4-6B, the impeller 62 is connected to the rotor 61 via a metal insert 46 disposed in the hub 66 of the impeller 62. By this configuration, the impeller 62 rotates about the rotational axis 36 in concert with the rotor 61. The impeller 62 includes a base plate 63 and the hub 66 that is centered on the base plate 63 and protrudes from a rotor-facing surface 65 thereof. In addition, the impeller 62 includes impeller blades 68 that protrude from the opposite surface (e.g., an inner surface) 64 of the base plate 63, and a curved shroud 80. The base plate 63 extends as a substantially flat disk in the radial direction. The impeller blades 68 are arranged on the base plate 63 and extend in a spiral around the rotational axis 36. The impeller blades 68 protrude from the base plate inner surface 64. The impeller blades 68 are disposed between the base plate 63 and the shroud 80 and face the pump housing primary inlet 24.

The impeller 62 is disposed within the fluid chamber 21 such that the base plate 63 is disposed near the motor pot open end 29. The shroud 80 is disposed between the base plate 63 and the pump housing 22, and an inner surface 84 of the shroud 80 rests on the free edges of the impeller blades 68. An outer surface 81 of the shroud 80 faces an inner surface 23 of the pump housing 22, and a narrow gap 88 is disposed between the shroud outer surface 81 and the pump housing inner surface 23. In some fluid pumps, the gap 88 provides a fluid path for leakage and recirculation of fluid, which can lead to inefficiency due to volumetric losses. The recirculation fluid path is represented by broken arrows in FIG. 4.

The shroud 80 has a concavely curved cross-sectional shape when viewed in a direction perpendicular to the rotational axis 36. In some embodiments, the shroud 80 may resemble a bell portion of a trumpet. The shroud 80 includes an inlet opening 82 that faces the primary inlet 24 of the pump housing 22, and an outlet opening 83 that is larger than the inlet opening 82 and faces the base plate 63. The impeller 62 is disposed within the fluid chamber 21 such that the inlet and outlet openings 82, 83 are concentric with the rotational axis 36.

The shroud 80 is tapered so as to have a minimum cross-sectional dimension at the inlet opening 82. The shroud inlet opening 82 permits fluid from the pump housing inlet 24 to be directed into the impeller blades 68. The impeller 62 draws fluid from the pump housing inlet 24 in an axial direction and redirects the main volume flow of the fluid out of the fluid chamber 21 in the radial direction via a volute 26 that is incorporated into the pump housing 22. The fluid path for the main volume of fluid flow through the impeller 62 is represented by solid arrows in FIG. 4. Fluid exiting the volute 26 is directed to the pump housing outlet 30.

The shroud 80 includes a notch 86 that is formed in a peripheral edge 85 of the shroud outlet opening 83. The notch 86 receives an upstanding key 69 that protrudes from the free edge of one of the impeller blades 68. By this configuration, the rotational orientation of the shroud 80 relative to the base plate 63 and impeller blades 68 is fixed.

Figure 5:
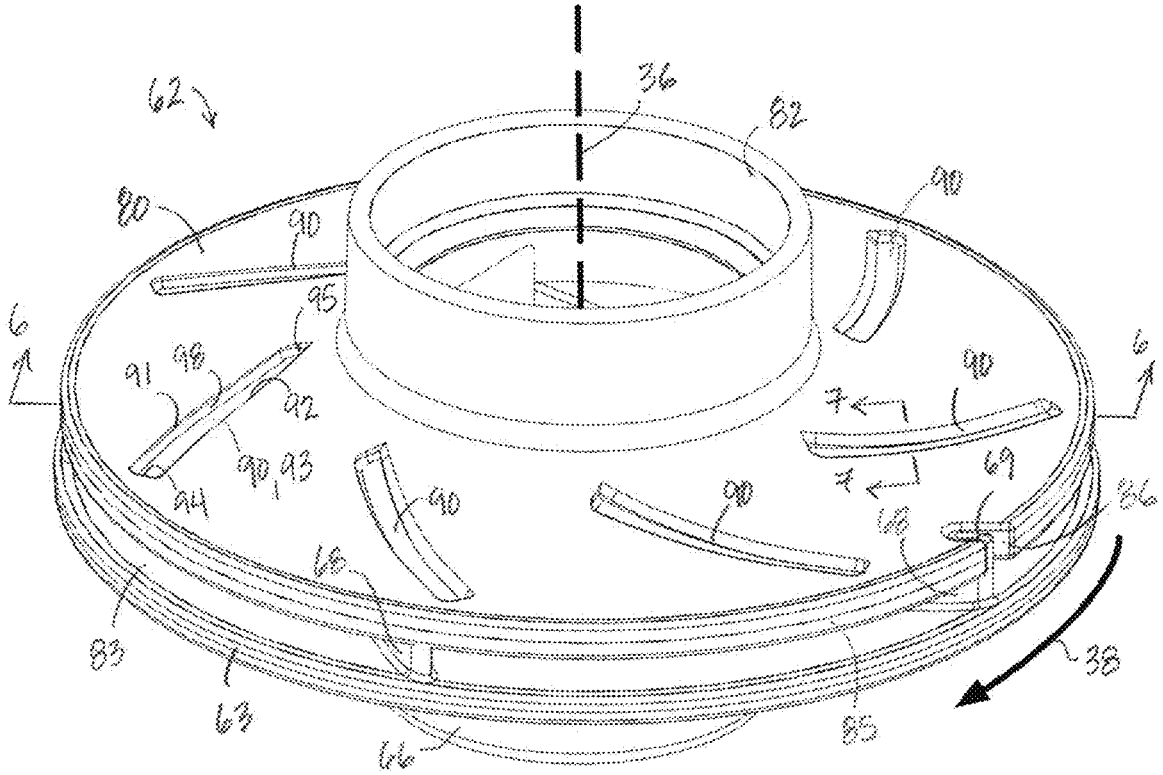
FIG. 5 is a perspective view of the impeller.
Figure 6A:
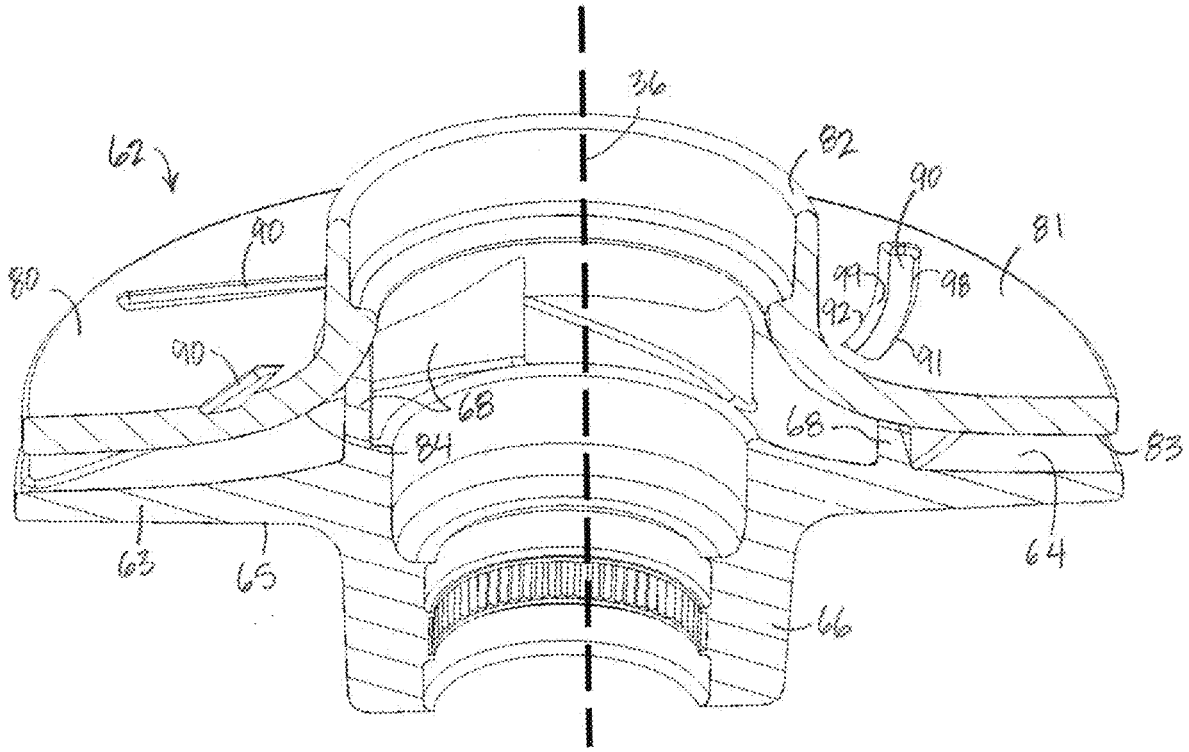
FIG. 6A is a cross-sectional view of the impeller as seen along line 6-6 of FIG. 5.
Figure 6B:
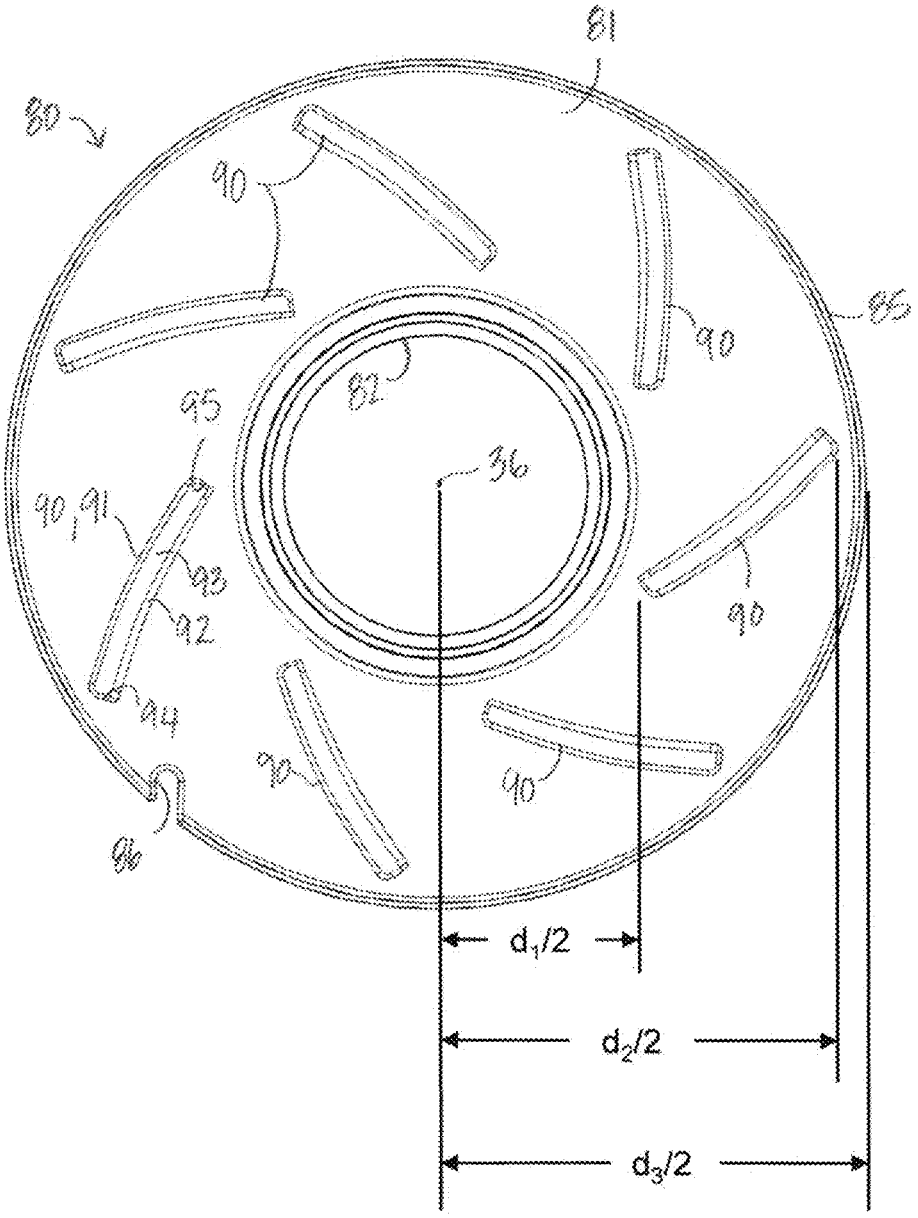
FIG. 6B is a top plan view of the impeller.
Figure 7:
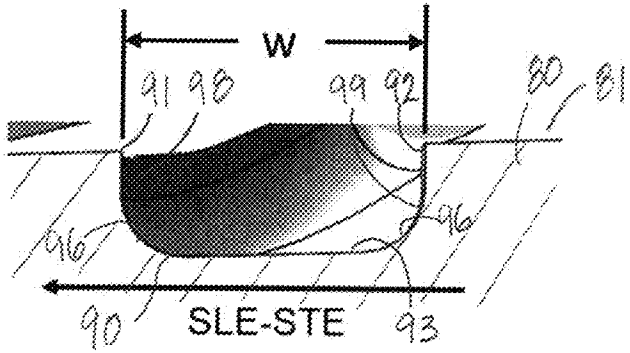
FIG. 7 is a cross-sectional view of a pump out vane as seen along line 77 of FIG. 5 illustrating a pump out vane having square leading and trailing edge profiles.

Referring to FIGS. 5-7, the shroud outer surface 81 includes pump out vanes 90 that reduce internal leakage and recirculation that may occur via the gap 88 that exists between the shroud 80 and the inner surface 23 of the pump housing 22. Each pump out vane 90 has a back skewed spiral shape when the shroud 80 is viewed in a direction parallel to the rotational axis 36. In addition, each pump out vane 90 is recessed into the shroud outer surface 81 in order to maintain the axial and radial clearances between the shroud 80 and the pump housing 22. The pump out vanes 90 are equidistantly spaced apart in a circumferential direction. The pump out vanes 90 act to pump fluid in a radially outward direction, e.g., out of the leakage path between the shroud 80 and the pump housing inner surface 23 and opposite in direction to the recirculation fluid path shown in FIG. 4.

The pump out vanes 90 are identical and each pump out vane 90 defines a curved, shallow and narrow channel in the shroud outer surface 81. As seen in the cross-section of the pump out vane 90 shown in FIG. 7, the cross-sectional shape of the pump out vane 90 is generally rectilinear, and includes a leading surface 98, a trailing surface 99 that is spaced apart from the leading surface 98 along a circumferential direction of the shroud 80, and a vane floor 93 that extends between the leading and trailing surfaces 98, 99.

The pump out vanes 90 include a leading edge 91 that corresponds to the intersection between the leading surface 98 and the shroud outer surface 81 and a trailing edge 92 that corresponds to the intersection between the trailing surface 99 and the shroud outer surface 81.

The direction of rotation of the impeller 62 is represented by arrow 38 in FIG. 5. During rotation of the impeller 62 about the rotational axis 36, the leading edge 91 and the leading surface 98 are in front of the trailing edge 92 and the trailing surface 99 with respect to the direction of shroud movement, and fluid disposed in the fluid chamber 21 meets the leading edge 91 and leading surface 98 of the pump out vane 90 before meeting the trailing edge 92 and trailing surface 99.

The vane floor 93 is recessed relative to the shroud outer surface 81 and extends between the leading and trailing surfaces 98, 99 of the pump out vane 90. In the illustrated embodiment, the vane floor 93 is generally parallel to the shroud outer surface 81.

The pump out vanes 90 include a vane root 95 corresponding to the surface of the pump out vane 90 that is closest to the rotational axis 36 (e.g., the radially innermost surface of the pump out vane 90). In addition, the pump out vanes 90 include a vane tip 94 corresponding to the surface of the pump out vane 90 that is furthest from the rotational axis 36 (e.g., the radially outermost surface of the pump out vane 90. The roots 95 of the pump out vanes 90 are each at the same distance from the rotational axis 36, whereby each pump out vane 90 has the same vane inner diameter d1. Similarly, the tips 94 of the pump out vanes 90 are each at the same distance from the rotational axis 36, whereby each pump out vane 90 has the same vane outer diameter d2. In particular, the vane inner diameter d1 corresponds to twice a distance between the rotational axis 36 and the vane root 95 of a given pump out vane 90, and the vane outer diameter d2 corresponds to twice a distance between the rotational axis 36 and the vane tip 94 of the given pump out vane 90.

The width w of each pump out vane 90 is unform between the vane root 95 and the vane tip 94, where the width w of the pump out vane 90 corresponds to a minimum distance between the leading surface 98 and the trailing surface 99 disregarding corner fillets if any.

In order to minimize fluid leakage and recirculation via the gap 88 between the shroud outer surface 81 and the pump housing 22, the configuration of shroud 80 may be optimized with respect to certain features of the pump out vanes 90 that affect pump performance. As previously mentioned, pump performance may be measured in terms of pump pressure or hydraulic efficiency, where the term "hydraulic efficiency" refers to the ratio R3 of hydraulic power produced by the pump 18 to the electrical power consumed by the pump 18. Such features of the pump out vanes 90 may include, in a first example, the edge profile of the leading and/or trailing edge 91, 92 at the intersection of the respective leading and trailing edge 91, 92 with the shroud outer surface 81.

Referring to FIG. 7, in some embodiments, the leading surface 98 of each of the vanes 90 of the shroud 80 is perpendicular to the shroud outer surface 81 whereby the leading edges 91 have a square edge profile. In addition, the respective trailing surfaces 99 are perpendicular to the shroud outer surface 81 whereby the trailing edges 92 have a square edge profile. In this configuration, a fillet 96 may be provided at the intersection of each of the leading surfaces 98 and the vane floor 93 and of the trailing surface 99 and the vane floor 93. For example, for a pump out vane 90 having a vane depth of 0.5 mm, the fillet 96 may have a radius of 0.3 mm.

Figure 8:
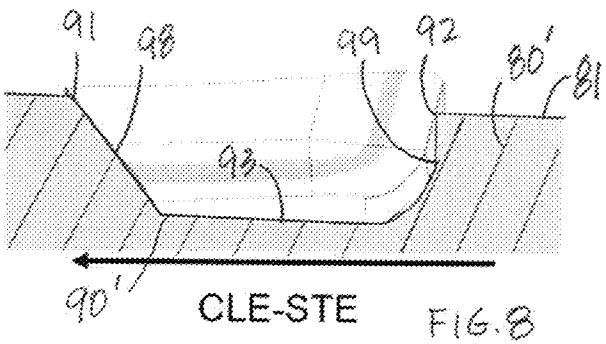
FIG. 8 is a cross-sectional view of an alternative embodiment pump out vane illustrating a pump out vane having a chamfered leading edge profile and a square trailing edge profile.

Referring to FIG. 8, in other embodiments, the leading surface 98 of each of the vanes 90' of the shroud 80' is obtusely angled relative to the shroud outer surface 81 whereby the leading edges 91 have a chamfered edge profile. The obtuse angle between the respective leading surfaces 98 and the shroud outer surface 81 may be in a range of 120 degrees to 150 degrees, for example about 135 degrees. In addition, the respective trailing surfaces 99 are perpendicular to the shroud outer surface 81 whereby the trailing edges 92 have a square edge profile. In this configuration, a fillet 96 may be provided at the intersection of each of the trailing surfaces 99 and the vane floor 93.

Figure 9:
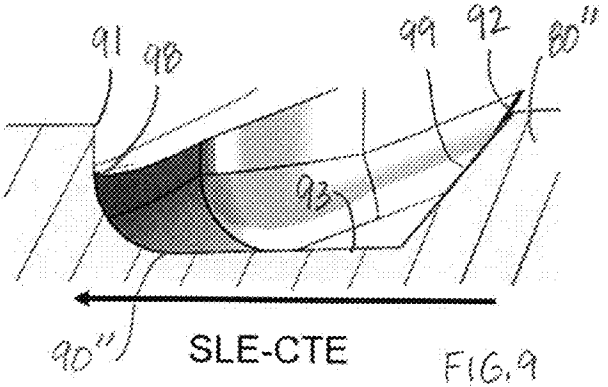
FIG. 9 is a cross-sectional view of another alternative embodiment pump out vane illustrating a pump out vane having a square leading edge profile and a chamfered trailing edge profile.

Referring to FIG. 9, in still other embodiments, the leading surface 98 of each of the vanes 90" of the shroud 80" is perpendicular to the shroud outer surface 81 whereby the respective leading edges 91 have a square edge profile. In addition, each of the trailing surfaces 99 is obtusely angled relative to the shroud outer surface 81 whereby the trailing edges 92 have a chamfered edge profile. The obtuse angle between each of the trailing surfaces 99 and the shroud outer surface 81 may be in a range of 120 degrees to 150 degrees, for example about 135 degrees. In this configuration, a fillet 96 may be provided at the intersection of the leading surface 98 and the vane floor 93.

Figure 10:
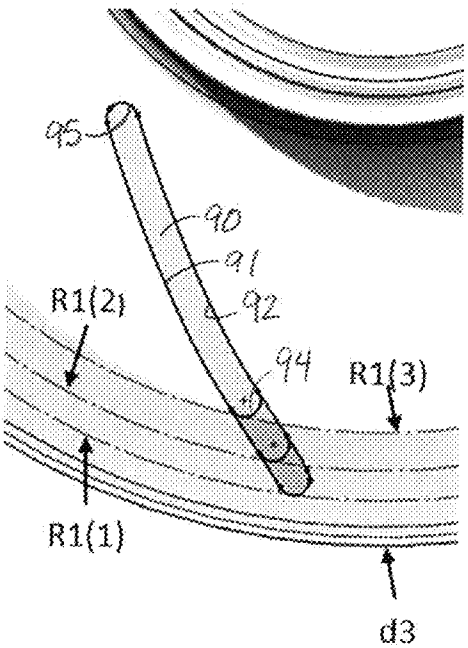
FIG. 10 is a top plan view of a portion of a shroud illustrating three possible vane diameters.

Referring to FIG. 10, in a second example of features of the pump out vanes 90, the vane outer diameter d2, which may be expressed as a ratio R1 of the vane outer diameter d2 to the outer diameter d3 of the shroud 80 (e.g., ratio R1=d2/d3), influences how well fluid is prevented from leakage and recirculation via the gap 88 and thus influences pump performance. In some embodiments, the ratio R1 of the vane outer diameter d2 to the outer diameter d3 of the shroud 80 is in a range of 0.8 to 0.98. In other embodiments, the ratio R1 of the vane outer diameter d2 to the outer diameter d3 of the shroud 80 is in a range of 0.9 to 0.96. In still other embodiments, the ratio R1 of the vane outer diameter d2 to the outer diameter d3 of the shroud 80 is in a range of 0.93 to 0.95. In some embodiments, the ratio R1 of the vane outer diameter d2 to the outer diameter d3 of the shroud 80 is 0.94.

In a third example of features of the pump out vanes 90, the number of pump out vanes 90 employed has an effect on how well fluid is prevented from leakage and recirculation via the gap 88 and thus influences pump performance. The number of pump out vanes 90 included in the shroud 80 is determined by the requirements of the specific application. Although highest pumping efficiency is provided in shrouds 80 having between five and nine vanes, the number of vanes employed may vary between two and twenty or more. In the embodiment illustrated in FIG. 5, the shroud 80 includes seven pump out vanes 90.

Figure 11:
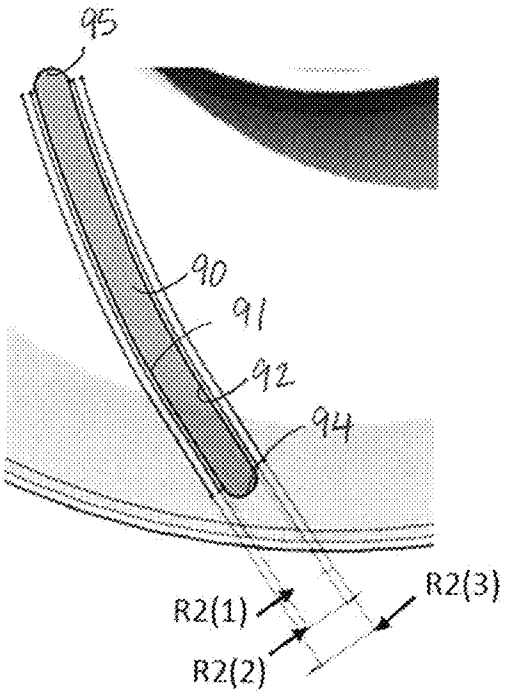
FIG. 11 is a top plan view of a portion of a shroud illustrating three possible vane widths.

Referring to FIG. 11, in a fourth example of features of the pump out vanes 90, the vane width w also influences how well fluid is prevented from leakage and recirculation via the gap 88 and thus influences pump performance. The vane width w may be expressed as a ratio R2 of the vane width w to the outer diameter d3 of the shroud 80 (e.g., ratio R2=w/d3). In some embodiments, the ratio R2 of the vane width w to the outer diameter d3 of the shroud is in a range of 0.02 to 0.04. In some embodiments, the ratio R2 of the vane width w to the outer diameter d3 of the shroud is 0.03.

Because the features of the pump out vanes 90 described above each have an effect on pump performance, a study was performed using the Taguchi Method to better understand the interaction between the features and to determine an optimal combination of these features. The Taguchi Method is a process or product optimization method that is based on planning, conducting and evaluating results of matrix experiments to determine the best levels of control factors. In the Taguchi Method, the primary goal is to keep the variance in the output very low even in the presence of noise inputs, whereby the processes or products are made robust against all variations.

To determine an optimal combination of features of the pump out vanes 90, the study evaluated four features of the pump out vanes 90 (e.g., variables), each variable having three values as follows:

Variable 1: Pump out vane width (mm). The three widths evaluated were 1.14 mm, 1.43 mm and 2.00 mm. For a shroud 80 having an outer diameter d3 of 51.98 mm, these widths respectively correspond to a ratio R2 of the vane width w to the outer diameter d3 of the shroud 80 as 0.02 (e.g., R2(1)), 0.03 (e.g., R2(2)), and 0.04 (e.g., R2(3)).

Variable 2: Ratio R1 of the vane outer diameter d2 to the outer diameter d3 of the shroud 80 (e.g., ratio R1=d2/d3). The three vane diameters evaluated, expressed as the ratio R1, were: 0.94 (e.g., R1(1)), 0.90 (e.g., R1(2)) and 0.85 (e.g., R1(3)).

Variable 3: Number of vanes. Shrouds having five pump out vanes 90 (e.g., N1), seven pump out vanes 90 (e.g., N2) and nine pump out vanes 90 (e.g., N3) were tested.

Variable 4. Pump out vane edge profile. The three edge profiles tested were chamfered leading edge with square trailing edge (e.g., CLE-STE), square leading and trailing edges (e.g., SLE-STE) and chamfered trailing edge with square leading edge (SLE-CTE).

Various combinations of the variables were tested in shrouds having an outer diameter of 51.98 mm. Each pump out vane 90 had a uniform depth of 0.5 min, and the roots 95 of the pump out vanes 90 were at a fixed radius relative to the rotational axis 36. Each pump out vane 90 had the same backward skewed shape.

In the study, the orthogonal array illustrated in FIG. 12 was used to determine the best combination of design parameters. The orthogonal array included nine test shrouds, each test shroud including a unique combination of the four variables. Each of the nine test shrouds was tested in a pump 18.

The results of the study indicated that the shroud sample corresponding to Test 4 had the best performance. The Test 4 shroud, illustrated in FIGS. 5 and 6, had the following configuration: A vane width R2(2) corresponding to 1.43 mm, a vane diameter R1(1) corresponding to a ratio R1 of 0.94, the number of vanes N2 corresponding to seven and the vane profile SLE-CTE corresponding to square leading edge and chamfered trailing edge.

Figure 13B:
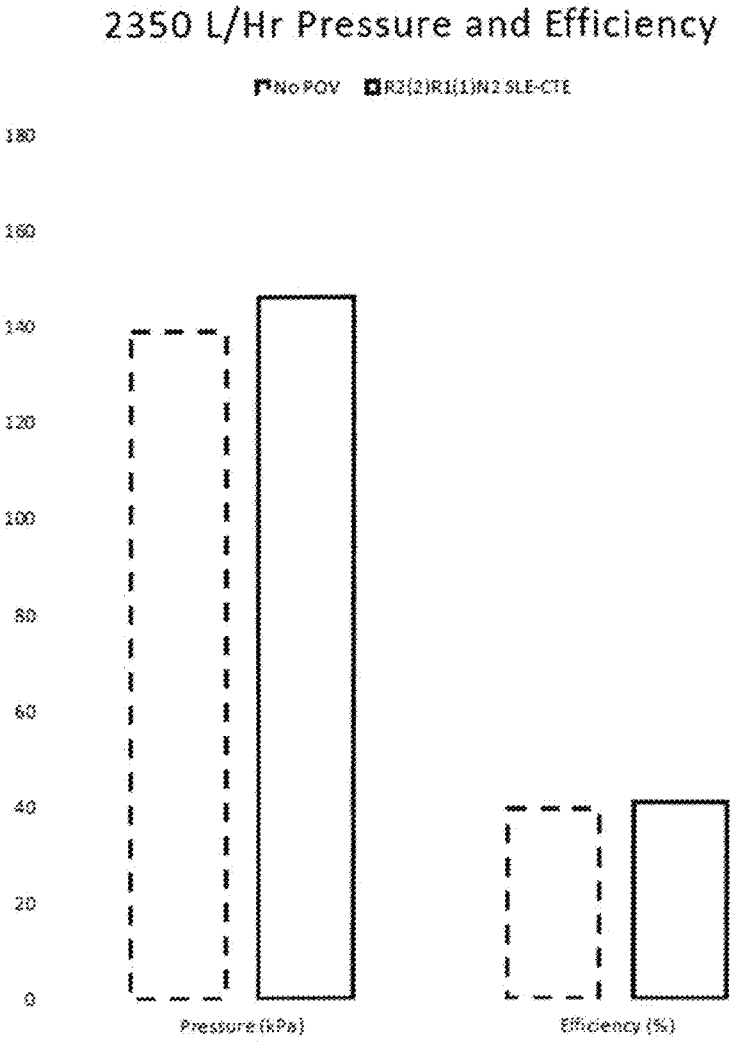
FIG. 13B is a bar graph illustrating pump pressure (kPa) and hydraulic efficiency (percent) of a pump operating at a fluid flow rate of 2350 liters per hour. Results are provided for a pump including a shroud having no pump out vanes (represented by broken lines) and for a pump including a shroud having pump out vanes (represented by solid lines) configured according to Test 4.
Figure 13A:
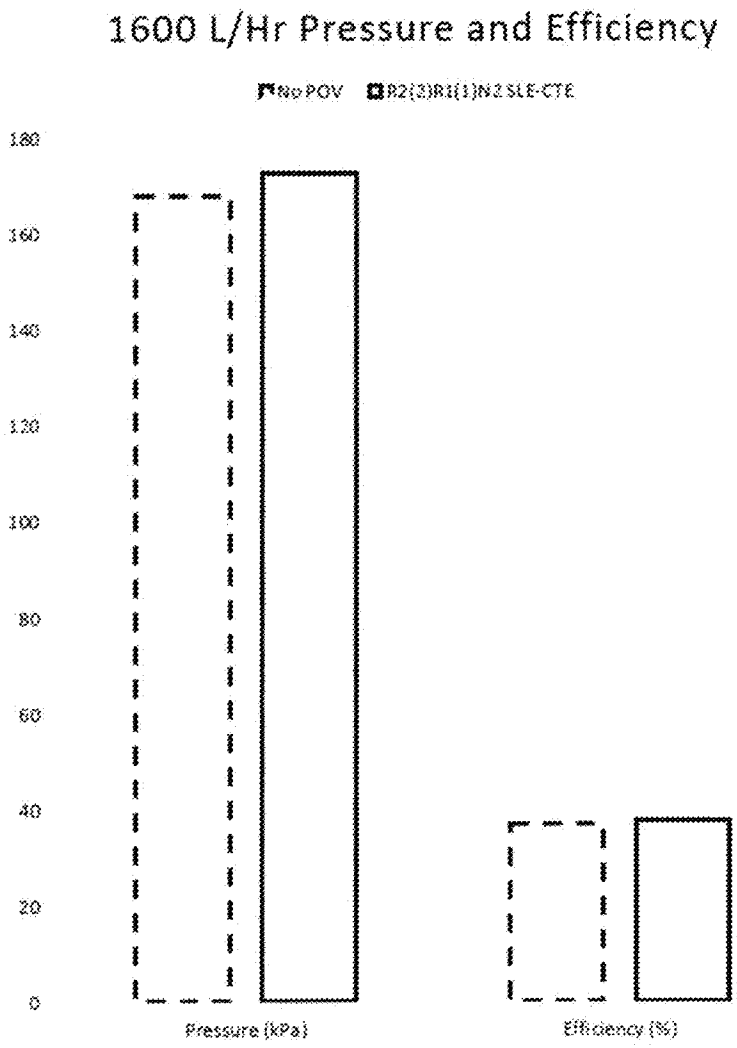
FIG. 13A is a bar graph illustrating pump pressure (kPa) and hydraulic efficiency (percent) of a pump operating at a fluid flow rate of 1600 liters per hour. Results are provided for a pump including a shroud having no pump out vanes (represented by broken lines) and for a pump including a shroud having pump out vanes (represented by solid lines) configured according to Test 4.

Referring to FIGS. 13A and 13B, pump performance for a pump 18 including a shroud having no pump out vanes and for a pump 18 including the Test 4 shroud are illustrated for two fluid flow rates.

FIG. 13A illustrates pressure and hydraulic efficiency at 1600 liters per hour. A fluid flow rate of about 1600 liters/hour may be appropriate for use in the power train cooling line of the vehicle cooling system 1. At the fluid flow rate of 1600 liters per hour, a pump including a shroud having the Test 4 configuration (shown in solid lines) provided a 0.5 percent mean hydraulic efficiency gain and a 5.22 kPA pressure increase as compared to an impeller in which the shroud was free of pump out vanes (shown in broken lines). Although the increase in hydraulic efficiency of 0.5 percent may be considered a modest improvement in performance, a pressure increase of 5 kPa or more may be considered to be a significant improvement in this type of pump.

At the fluid flow rate of 1600 liters per hour, it was determined that vane diameter had the greatest impact on pump efficiency, followed in order by vane width, vane edge profile and vane number. In addition, at the fluid flow rate of 1600 liters per hour, it was determined that vane number had the greatest impact on pump pressure, followed in order by vane diameter, vane edge profile and vane width.

FIG. 13B illustrates pressure and hydraulic efficiency at 2350 liters per hour. A fluid flow rate of about 2350 liters/hour may be appropriate for use in the battery cooling line of the vehicle cooling system 1. At the fluid flow rate of 2350 liters per hour, a pump 18 including a shroud having the Test 4 configuration (shown in solid lines) provided a 0.5 percent mean hydraulic efficiency gain and a 7.39 kPA pressure increase as compared to an impeller in which the shroud was free of pump out vanes (shown in broken lines).

At the fluid flow rate of 2350 liters per hour, it was determined that vane diameter had the greatest impact on pump efficiency, followed in order by vane edge profile, vane number and vane width. In addition, at the fluid flow rate of 2350 liters per hour, it was determined that vane number had the greatest impact on pump pressure, followed in order by vane edge profile, vane diameter and vane width.

Figure 14:
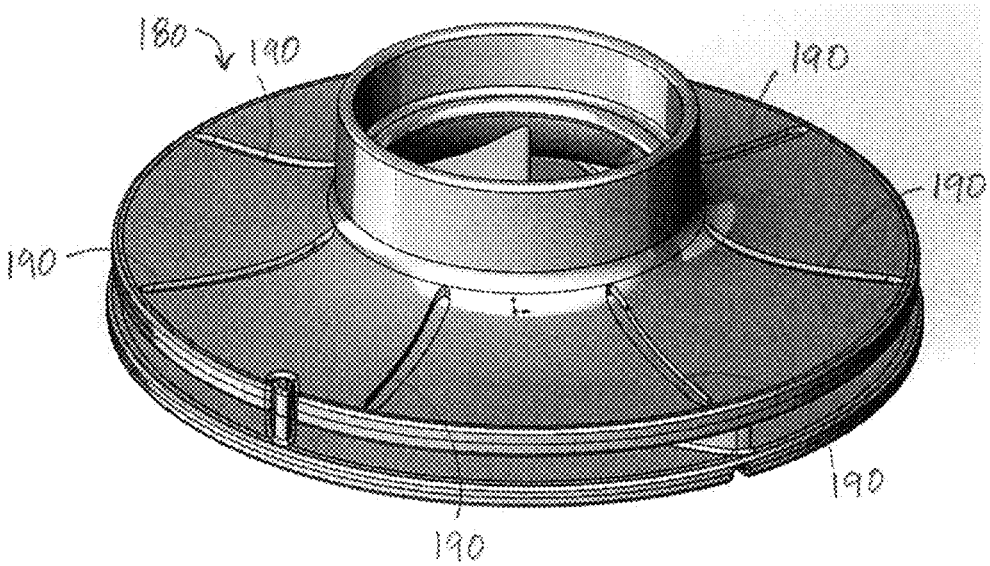
FIG. 14 is a perspective view of an alternative embodiment shroud including linear, radially-extending pump out vanes.

Referring to FIG. 14, although the pump out vanes 90 described above each have a back skewed spiral shape when the shroud 80 is viewed in a direction parallel to the rotational axis 36, the pump out vanes 90 are not limited to this shape. For example, in an alternative embodiment shroud 180, each pump out vane 190 may extend linearly along a radius of the shroud 180.

In the illustrated embodiments, the shroud 80, 180 is free of splitter vanes or partial length vanes (e.g., vanes intermediate the pump out vanes 90 that have a ratio of the vane diameter to the shroud outer diameter of 1.0) disposed between the pump out vanes 90. However, in other embodiments, the shroud 80, 180 may include splitter vanes or partial length vanes disposed between the pump out vanes 90 if warranted by the specific application.

Selective illustrative embodiments of an impeller including a shroud having pump out vanes are described above in some detail. It should be understood that only structures considered necessary for clarifying the impeller and shroud have been described herein. Other conventional structures, and those of ancillary and auxiliary components of the pump, impeller and shroud are assumed to be known and understood by those skilled in the art. Moreover, while a working example of the impeller including the shroud having pump out vanes has been described above, the vehicle cooling system, the pump and the impeller are not limited to the working example described above, but various design alterations may be carried out without departing from the device as set forth in the claims.

We claim:

1. An impeller for a centrifugal pump, the impeller being rotatable about a rotational axis, the impeller comprising:
- a shroud including
  - a shroud outer surface,
  - a shroud inner surface, and
  - a shroud outer diameter;
- a base plate including a base plate inner surface; and
- impeller blades that are disposed between the shroud inner surface and the base plate inner surface, the shroud outer surface including pump out vanes, each pump out vane comprising:
- a leading edge;
- a trailing edge;
- a vane floor that extends between the leading edge and the trailing edge;
- a tip corresponding to a radially outer most edge of the vane,
- a vane width corresponding to a distance between the leading edge and the trailing edge,
- a vane outer diameter corresponding to a distance between the rotational axis and the tip, wherein
- the vane floor of each pump out vane is recessed relative to the shroud outer surface, and
- for each pump out vane, the ratio of the vane outer diameter to the shroud outer diameter is in a range of 0.8 to 0.98.

2. The impeller of claim 1, wherein for each pump out vane, the ratio of the vane outer diameter to the shroud outer diameter is in a range of 0.9 to 0.96.

3. The impeller of claim 1, wherein for each pump out vane, the ratio of the vane outer diameter to the shroud outer diameter is in a range of 0.93 to 0.95.

4. The impeller of claim 1, for each pump out vane, the ratio of the vane outer diameter to the shroud outer diameter is 0.94.

5. The impeller of claim 1, wherein the shroud outer surface is free of pump out vanes having a ratio of the vane outer diameter to the shroud outer diameter of 1.0.

6. The impeller of claim 1, wherein for each pump out vane, the ratio of the vane width to the shroud outer diameter the vane width is in a range of 0.02 to 0.04.

7. The impeller of claim 1, wherein for each pump out vane, the ratio of the vane width to the shroud outer diameter the vane width is 0.03.

8. The impeller of claim 1, wherein, for each pump out vane, the leading edge is square and the trailing edge is chamfered.

9. The impeller of claim 1, wherein, for each pump out vane, the leading edge is square and the trailing edge is square.

10. The impeller of claim 1, wherein the number of vanes is seven.

11. The impeller of claim 1, wherein each pump out vane has a back skewed spiral shape when the shroud is viewed in a direction parallel to the rotational axis.

12. The impeller of claim 1, wherein each pump out vane extends linearly along a radius of the shroud.

13. The impeller of claim 1, wherein each pump out vane has a constant width between a root of the vane and the tip of the vane, where the root corresponds to a radially innermost edge of the vane.

* * * * *